United States Patent [19]

Akel

[11] Patent Number: 4,792,271

[45] Date of Patent: Dec. 20, 1988

[54] GOLF BALL RETRIEVER

[76] Inventor: Fred A. Akel, 55 S. Roscoe Blvd., Ponte Vedra Beach, Fla. 32082

[21] Appl. No.: 907,028

[22] Filed: Sep. 15, 1986

[51] Int. Cl.[4] ..... B60P 1/00

[52] U.S. Cl. ..... 414/440; 56/328.1; 414/507

[58] Field of Search ..... 414/434, 437, 439, 440, 414/441, 507; 56/328 R

[56] References Cited

U.S. PATENT DOCUMENTS

| | | | |
|---|---|---|---|
| 2,365,540 | 12/1944 | Fonken | 414/440 |
| 2,413,679 | 1/1947 | Binder . | |
| 2,651,902 | 9/1953 | Curry . | |
| 2,656,061 | 10/1953 | Lockie | 414/440 |
| 2,658,637 | 11/1953 | Bailey | 414/440 |
| 2,812,871 | 11/1957 | Woodall . | |
| 3,175,714 | 3/1965 | Wittek | 414/440 |
| 3,253,392 | 5/1966 | Barrat | 56/328 R X |
| 3,306,480 | 2/1967 | Wysong . | |
| 3,566,893 | 3/1971 | Richardson . | |
| 3,630,401 | 12/1971 | Gustafson | 56/328 R X |
| 3,788,506 | 1/1974 | Lee . | |
| 3,856,165 | 12/1974 | Gustafson et al. | 414/440 |
| 3,995,759 | 12/1976 | Hollrock et al. | 414/440 |
| 4,077,533 | 3/1978 | Meyer | 414/440 |
| 4,199,913 | 4/1980 | Hood et al. | 56/328 R X |
| 4,645,254 | 2/1987 | Warden | 56/328 R X |

FOREIGN PATENT DOCUMENTS

| | | | |
|---|---|---|---|
| 1213827 | 4/1960 | France | 56/328 R |
| 891014 | 12/1981 | U.S.S.R. | 56/328 R |

*Primary Examiner*—Kenneth J. Dorner
*Assistant Examiner*—Thomas A. Rendos
*Attorney, Agent, or Firm*—Arthur G. Yeager

[57] ABSTRACT

An apparatus for retrieving golf balls distributed over the ground comprising a frame mounted on an axle and two rear wheels, a plurality of thin circular discs spaced apart from each other slightly less than the diameter of a golf ball and mounted on the rear wheel axle to turn with the wheels with the perimeter of the disc being in close proximity to the ground level, fingers between the discs to strip golf balls from between adjacent discs, baskets to catch the balls stripped by the fingers, and elongated guides extending forward from the frame to funnel golf balls from a wide area toward the rotating discs.

13 Claims, 4 Drawing Sheets

GOLF BALL RETRIEVER

BACKGROUND OF THE INVENTION

With the widespread use of golf driving ranges there has come a need for devices that can rapidly pick up golf balls lying on the ground over a sizeable area of several acres. It is necessary for the proprietor of such a range to pick up hundreds or thousands of golf balls several times a day, wash them, and package them for reuse. Many different types of apparatus have been suggested although all generally involve a wheeled cart that can be rolled over the area, preferably pushjed by a small electric or gasoline powered vehicle driven by a person. The method of picking up the balls has taken many different designs, although the most popular appears to be that which includes a plurality of spaced wheels, the spaces between wheels being enough to pinch the ball between adjacent wheels, lift the ball off the ground as the wheels rotate, strip the ball out of the position between wheels, and catch the ball in a basket or other container. Typical of such an apparatus is that shown in U.S. Pat. No. 2,365,540. In U.S. Pat. No. 2,658,637 the spaced wheels roll on the ground and support the cart as well as pick up golf balls. In U.S. Pat. Nos. 3,630,401 and 3,856,165 the golf balls are funneled into a single pick-up space near each of the supporting wheels. The varieties of design have been numerous, but there remained several reasons why improvements were still necessary. For example, some designs were too heavy and tended to mash some golf balls into the ground instead of picking them up. Other designs did not pick up enough golf balls in one pass over the area, and therefore, were not efficient.

It is an object of this invention to provide a novel and efficient apparatus for picking up large numbers of golf balls in one sweep of the area. It is another object of this invention to provide an improved light weight golf ball retriever. Still other objects will become apparent from the more detailed description which follows.

BRIEF SUMMARY OF THE INVENTION

This invention relates to a golf ball retrieving apparatus comprising a frame supported on a rear axle and two rear wheels, two elongated outside deflecting members positioned slightly above ground level and extending forward and diverging laterally outward from the outer portion of said frame with a wheel supporting the forward end of each deflecting member, a plurality of spaced disc members mounted on said axle between said wheels and adapted to turn with said wheels, a plurality of spaced, stationary fingers extending inwardly in the spaces between adjacent disc members with their fixed ends forward of said disc members and their free ends between said disc members, and a basket located forward of said disc members adapted to catch balls stripped from between adjacent disc members by said fingers.

In a preferred embodiment of this invention the disc members are made of polycarbonate and have a plurality of concentric grooves on both sides adjacent the outside perimeter. In another preferred embodiment there are two spaced sections of disc members separated by a centrally located basket, guide members forming two funnels to direct golf balls to each of the sections of disc members, and a concave deflector to deflect a portion of the golf balls from each section of disc members into the central basket. In still another preferred embodiment the guide members have a plurality of spaced pivotally mounted teeth to deflect golf balls toward the center portion of the disc members.

BRIEF DESCRIPTION OF THE DRAWINGS

The novel features believes to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
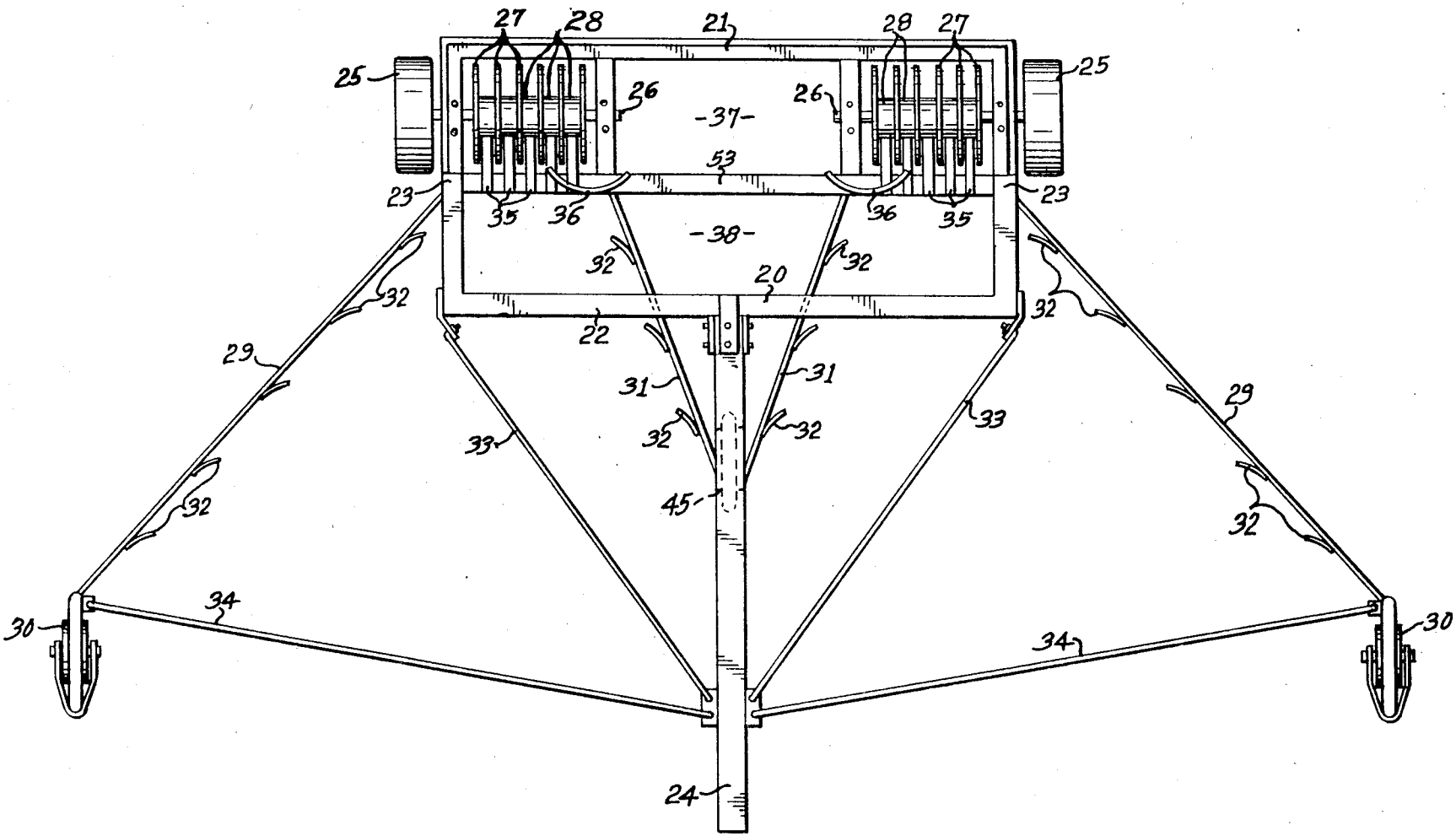
FIG. 1 is a top plan view of one embodiment of this invention.

The general features of this invention may best be understood by reference to FIGS. 1–4.

A generally rectangular frame 20 comprises a rear member 21, a front member 22, and two lateral side members 23. Other members may be included to form supports for component parts or to strengthen the frame. For example, central member 53, is shown as a support for certain component parts which will be described below. Frame 20 is supported on axles 26 upon which rear wheels 25 are rotatably mounted. In this embodiment axles 26 are shortened so as to leave a space 37 for a removable basket 46 (not shown in FIG. 1 but see FIGS. 5 and 6). Projecting forwardly of frame 20 is tongue 24 which may be attachable to a powered vehicle that pulls the frame 20 behind. If the apparatus of this invention is to be pushed from behind rear frame member 21 an attaching means may be fastened thereto.

Guide members 29 extend forwardly and diverge outwardly from side frame members 23 with their lower edges parallel to and slighly above ground level. The forward ends of guide members, which are elongated, are supported on wheel means 30. For purposes of strength and rigidity tie rods 33 connect the forward corners of frame 20 to the forward portion of tongue 24, and tie rods 34 connect wheels 30 to the forward portion of tongue 24.

The portion of the apparatus that picks up the golf balls includes one or more sections of spaced disc members 27 which are maintained at a distance from the next adjacent disc member 27 which is slightly less than the diameter of a golf ball. Spacers 28 between adjacent disc members 27 provide the accurate spacing that is required. Disc members 27 are thin, circular discs of a semi-flexible semi-rigid material that provides a good frictional contact with a golf ball. It is preferred to employ a plastic material such as polycarbonate, polyacetal, polyolefin, polyamide, or the like since such materials have the required flexibility in discs having a thickness of about 0.1 to about 0.25 inch and about 10–12 inches in diameter, since they are relatively inexpensive and since they are not easily broken or eroded in use. As wheels 25 turn, disc members 27 also turn and will pinch a golf ball between adjacent disc, picking it up from the ground as disc member 27 continues to rotate. Fingers 35 are positioned between adjacent disc members 27 with one end affixed to central member 53 or other equivalent part of frame 20, and the free end extending inwardly between adjacent disc members 27. With the fixed end of finger 35 forward of axle 26, it will be appreciated that any golf ball picked up on the ground will rotate through some angle between 180° and 270° before the free end of finger 35 contacts the golf ball and strips it away from contact with disc members 27. Baskets 39 or 46 are positioned to catch the golf balls stripped away from disc members 27. Generally such baskets should be supported in the opening 38 of frame 20 to receive golf balls from fingers 35.

One embodiment of this invention is shown in FIGS. 1, 2 and 5–7 where there are two spaced sections of disc members 27 separated by opening 37 for receiving basket 46 therein. Two other baskets 39 each extend half way across opening 38. In order to divert some golf balls into basket 46 and others into baskets 39, two concave diverting shields are affixed forward and closely adjacent to fingers 35 of a few disc members 27 which are in close proximity to basket 46 (or opening 37 of FIG. 1). Balls coming from fingers 35 of those disc members 27 at the inner ends of axles 26 are caught by the rearwardly facing concave surface of deflectors 36 and directed to fall in basket 46. Those golf balls picked up by disc member 27 at the outer ends of axles 26 are directed to the front by fingers 35 to fall into baskets 39. As may be seen in FIGS. 8–10 the second embodiment has a single continuous section of spaced disc members 27 extending from one wheel 25 to the other. This embodiment allows all golf balls to be discharged forwardly from disc members 27 and therefore the entire opening 38 is filled with baskets 39 and no deflectors 36 are used.

Figure 4:
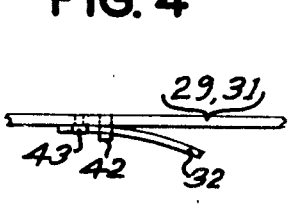
FIG. 4 is a top plan view of the tooth shown in FIG. 3.
Figure 3:
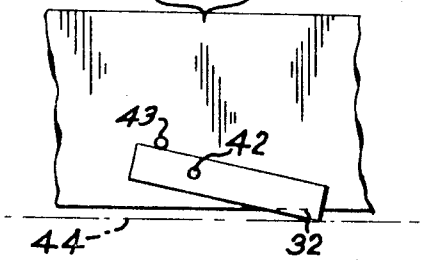
FIG. 3 is a partial front elevational view of a deflector tooth employed in this invention.

When the first embodiment is employed there is added to the apparatus a pair of inside guide members 31 which attach to frame 20 at the inner end of each section of disc members 27 and extends forwardly and convergingly toward tongue 24. The combination of one outside guide member 29 and one inside guide member 31 forms a funnel shaped collection zone to direct golf balls from a wide area to a narrower pick up location under spaced disc members 27. An additional, although optional feature is a plurality of deflecting teeth 32 attached to the lower edge of guide members 29 and 31. These teeth 32 are pivotally mounted on pins 42 (see FIGS. 3 and 4) so that the trailing corner will drag on the ground 44 as the apparatus moves along. Stop pins 43 prevent the trailing corner from digging into the ground. As seen in FIG. 4, the training portion of tooth 32 is bent or angled inwardly away from guide member 29 or 31. The purpose of teeth 32 is to deflect golf balls to the area between respective guide members 29 and 31 so as to more evenly distribute the balls when disc members 27 approach. Otherwise balls might tend to pile up next to the guide members 29 and 31 and jam the spaces between disc members adjacent wheels 25.

Figure 2:
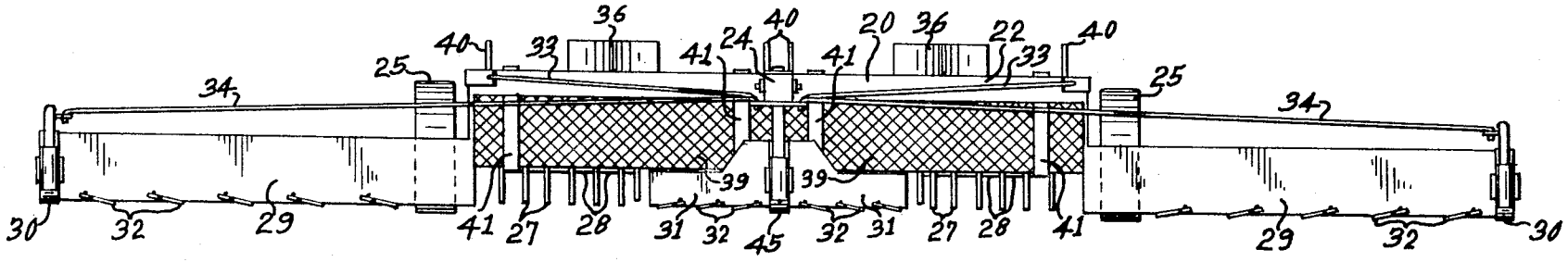
FIG. 2 is a front elevational view of the embodiment of FIG. 1.

In FIG. 2 there is shown a central wheel 45 which is optional. Generally the four wheels 25 and 30 are sufficient, but if desired a fifth wheel 45 may be employed under tongue 24 at any location from the forward end of tongue 24 to its juncture with front frame member 22.

Figure 5:
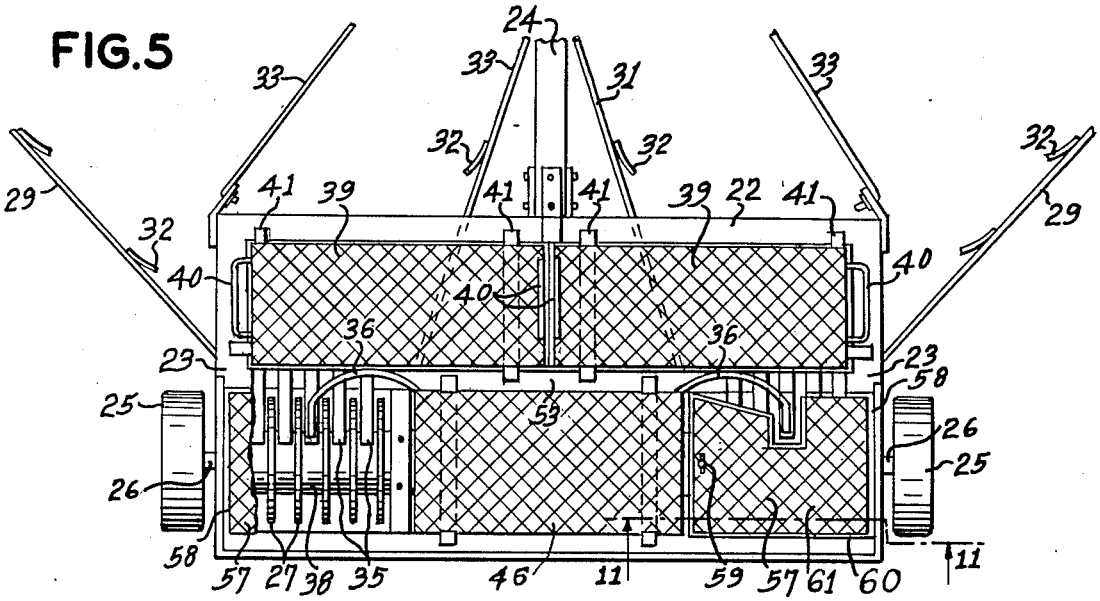
FIG. 5 is a top plan view of the embodiment of FIG. 1 shown in greater detail than that of FIG. 1.
Figure 6:
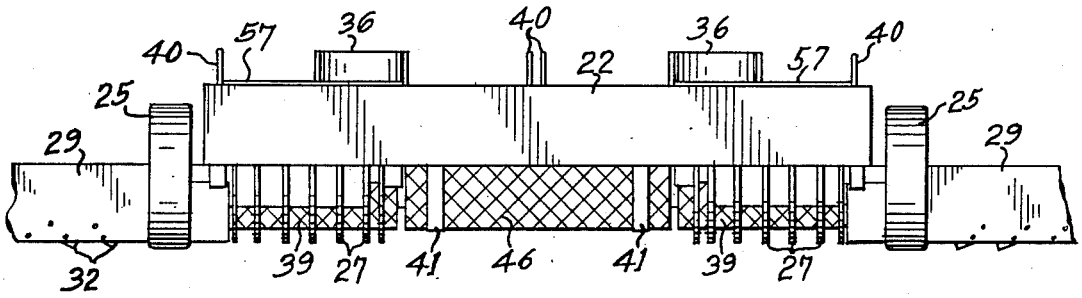
FIG. 6 is a rear elevational view of the embodiment shown in FIG. 5.
Figure 7:
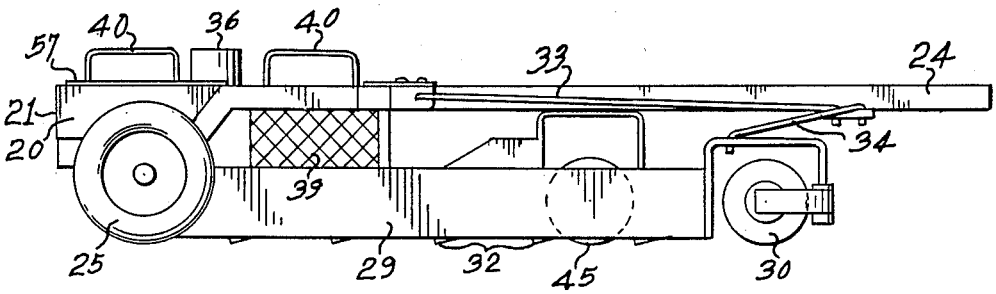
FIG. 7 is a side elevational view of the embodiment shown in FIG. 5.

In FIGS. 5–7 there is shown a more detailed view of the main portion of the apparatus around frame 20, which is preferably divided into two laterally elongated bays by reason of central frame member 53. The forward bay is fitted with strap supports 41 which support two baskets 39 with upstanding handles 40 at each end thereof to facilitate removal from frame 20. The rear bay is located directly above axles 26. The length of the rear bay is divided approximately into thirds with the two outside thirds employed for a group of disc members 27 while the middle third serves as a space for rear basket 46 supported by straps 41 and having handles 40 at each end thereof. Each group of disc members 27 includes associated fingers 35 and spacers 28 as described above. It may be seen that each section is shown as having five spaces for picking up balls. The inner two spaces of each section of disc members 27 are associated with a concave deflector 36 to divert the balls removed by fingers 35 in those two spaces to fall into basket 46. The outer three spaces of each section of disc members 27 feed golf balls into baskets 39 to the front. It is to be understood that the distance between wheels 25 and the proportions assigned to disc members 27 and to basket 46 may be varied, as well as the number of spaces associated with deflector 36. If needed, the outer edges of frame members 21, 22, and/or 23 may be extended upward to form a backstop to catch balls that may be stripped out of spaces between disc members 27 more forcibly than expected or may bounce around more than anticipated. Guide members 29 and 31 are shown as thin, elongated strips having a substantial vertical width, which is the preferred shape. The vertical width is preferred to keep balls from bouncing over the top. The strip may be backed with stiffening beams if they are too flexible, or they may be made entirely of an L-shaped section or other shape more stiff than a strip.

There is also shown in FIGS. 5–7 a preferred alternative wherein each of the sets of disc members 27 is covered with an expanded metal cover 57 to prevent golf balls from bouncing out of engagement with disc members 27 and falling to the ground again. A cover 57 is made of an outer support rim 60 of metal strip to which an expanded metal center 61 is attached (also see FIG. 11). Cover 57 is attached to frame member 23 by a hinge 58 and is fastened down at the opposite end by a wing nut fastener 59 or the like. Such covers may be desirable if the golf ball pick-up mechanism is operated at higher than normal speeds.

Figure 8:
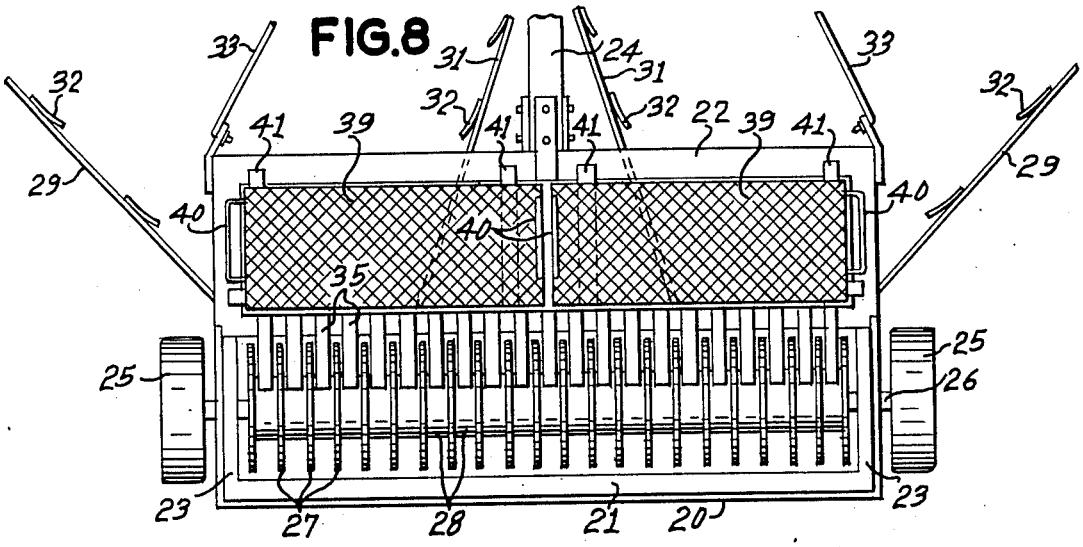
FIG. 8 is a top plan view of a second embodiment of this invention.
Figure 9:
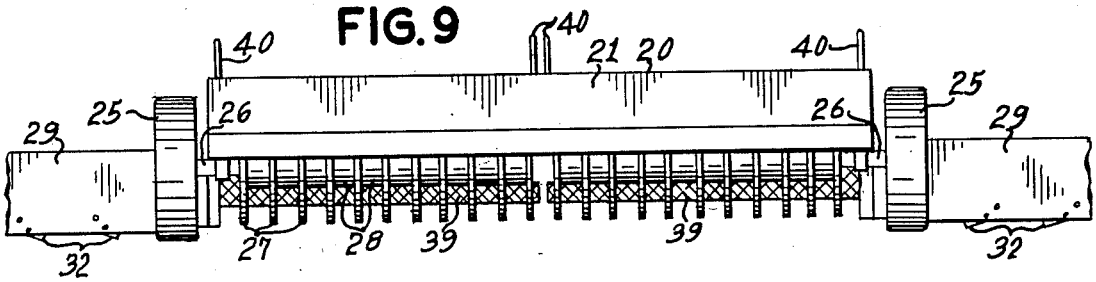
FIG. 9 is a rear elevational view of the embodiment shown in FIG. 8.
Figure 10:
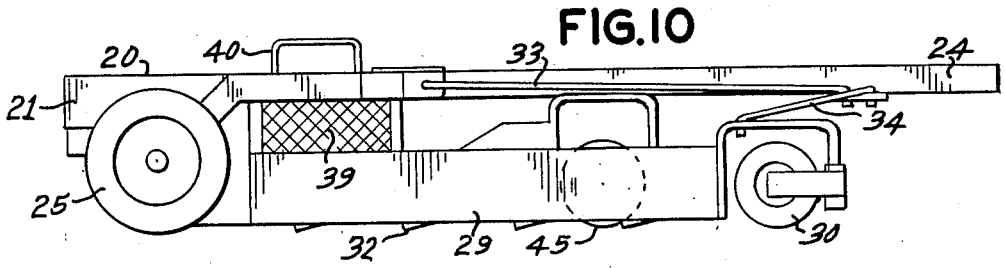
FIG. 10 is a side elevational view of the embodiment shown in FIG. 8.

In FIGS. 8–10 there is shown a second embodiment of the invention which differs from that of FIGS. 5–7 in that the entire space between wheels 25 is filled with spaced disc members 27. This provides more "pick-up" function and less basket volume. Such an embodiment may be preferred when the balls are spread over a small area in dense concentrations. In this embodiment a single axles 26 extends from one wheel 25 to the other wheel 25 and does not employ concave deflectors 36. All balls are discharged forwardly into the two baskets 39. Otherwise the structure and operations of this second embodiment are identical to those described above with respect to FIGS. 1–7.

Figure 13:
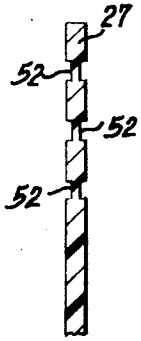
FIG. 13 is a cross sectional view taken at 13—13 of FIG. 12.
Figure 12:
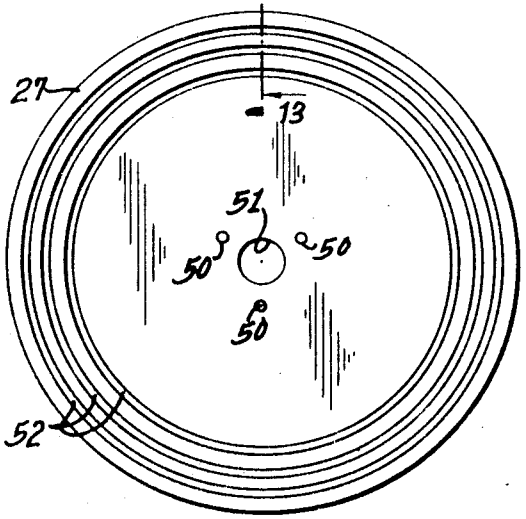
FIG. 12 is a top plan view of a disc member.
Figure 11:
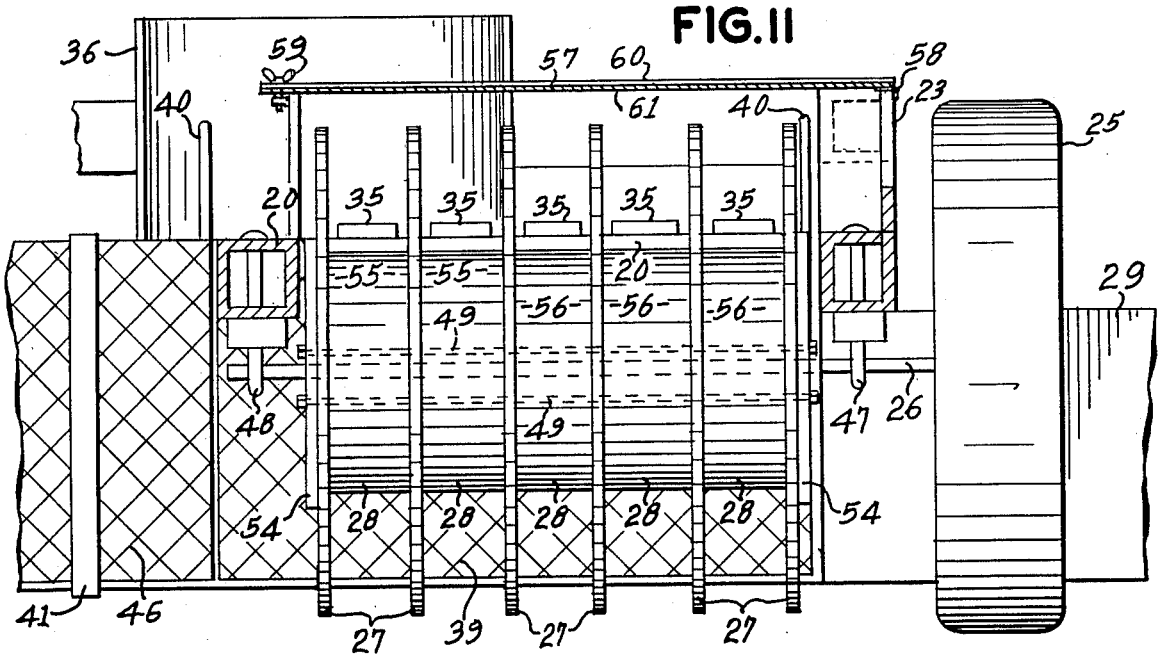
FIG. 11 is an enlarged cross-sectional view taken at 11—11 of FIG. 5.

FIG. 11 shows an enlarged cross sectional view of one sectional of disc members 25 and the associated parts of the apparatus. FIGS. 12 and 13 show the structure of a preferred disc member 27. Frame 20 is shown as an assembly of square tubing and strips welded together. Other beam sections such as I-beam, angle beam, etc., may be used with equivalent results. Attached to frame 20 are two bushings or journal bearings 47 and 48 to support axle 26. The assembly of disc members 27 is attached to axle 26 between bushings 47 and 48. This assembly includes a plurality of disc members 27, a plurality of spacers 28, and means to attach the assembly to axle 26. Disc members 27 are thin semi-flexible circular discs of plastic material, preferably polycarbonate. A desirable polycarbonate is sold under the trademark "Lexan" by General Electric Co. Discs about 0.1 to 0.25 inch in thickness provides the required stiffness and flexibility characteristics to bend when golf balls are inserted between adjacent discs, to hold balls therein by appropriate frictional forces, and to resist wear and erosion. To enhance the frictional holding forces it is desirable to employ a plurality, e.g., 2–5, concentric grooves 52 near the outer perimeter where the golf ball will be gripped.

Spacers 28 may be any convenient means for holding disc members 27 at the proper spacing, which may be 0.05 to 0.10 inch less than the diameter of a golf ball, which in the United States is about 1.68 inches in diameter. The material employed in a preferred embodiment for spacers 28 is a length of PVC pipe about 6 inches in diameter. The assembly of disc members 27 and spacers 28 is held together by three long bolts 49 pasing through bolt holes 50 in disc members 27. The assembly is affixed to axle 26 in any convenient fashion, e.g., by being assembled between end plates 54 to which bolts 49 are attached, with end plates 54 being rigidly attached to axle 26. Plates 54 may be welded to axle 26 or attached to flanges which in turn are attached to axle 26 by set screws or other fastening means. Axles 26 passes through opening 51 in each disc member 27. Fingers 35 are flat pieces of strip metal or plastic placed in a cantilever fashion between adjacent disc members 27. A fixed end of each finger 35 is bolted or otherwise fastened to frame 20 forward of disc members 27 and a free end of finger 35 extends rearwardly from frame 20 sufficient to catch any golf ball in that space, but not so far as to touch spacer 28 and not beyond a vertical plane through axle 26.

Deflector 36 is mounted forward of fingers 35 and extends laterally from a selected disc member 27 to beyond the nearest edge of basket 46. In this instance deflector 36 services the inner two spaces 55 between disc members 27 and deflects golf balls in spaces 55 to basket 46. Golf balls in the outer spaces 56 are not diverted by deflector 36 and are collected by forward basket 39.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A golf ball retrieving apparatus comprising a frame supported by a rear axle means and two spaced ground engaging rear wheels mounted to opposite end portions of said axle means, two elongated outside deflecting members having free forward end portions and positioned slightly above ground level and extending forward and diverging laterally outward from the outer portion of said frame, two spaced ground engaging wheels supporting respective forward end portions of said deflecting members, a plurality of spaced generally rigid disc members mounted on said axle means between and laterally spaced inwardly from said rear wheels and adapted to turn respectively with said rear wheels, said disc members having a diameter less than the diameter of said rear wheels thereby spacing the outer edges of said dics members upwardly from the ground so that said outer edges do not engage the ground, a plurality of spaced, stationary fingers extending inwardly in the spaces between adjacent disc members with their fixed ends forward of said disc members and their free ends between said disc members, and basket means located forward of said disc members adapted to catch balls stripped from between adjacent disc members by said fingers.

2. The apparatus of claim 1 wherein each said disc member is formed of a plastic material having opposite sides and a plurality of concentric grooves adjacent its outer edge and on each said opposite sides.

3. The apparatus of claim 1 which additionally comprises two elongated inside deflecting members positioned slightly above ground level and extending forwardly and convergingly from the central portion of said frame so as to form with said outside deflecting members two funnel collectors leading to said spaced disc members.

4. The apparatus of claim 3 wherein said spaced disc members are assembled in two laterally spaced sections with more than two said disc members in each said section, each said section being adjacent to and extending inwardly from respective said rear wheel, and a rear basket between said two spaced sections generally aligned with said axle means and said disc members, and a concave-convex deflector mounted above a portion of said fingers adjacent said rear basket with the concave side facing to the rear and adapted to deflect balls into said rear basket from said fingers adjacent to said rear basket.

5. The apparatus of claim 1 wherein said basket means includes at least one forward basket in front of said axle means and a rear basket being located generally in alignment with said axle means generally medially between and spaced inwardly of said rear wheels with more than two of said disc members being located between said rear basket and respective said rear wheel.

6. The apparatus of claim 5 further comprising deflecting means cooperating with at least a portion of said fingers adjacent said rear basket for deflecting balls therefrom into said rear basket.

7. The apparatus of claim 6 wherein said deflecting means includes a pair of deflectors respectively positioned adjacent each end portion of said rear basket whereby balls are deflected by each said deflector adjacent each said rear basket end portion.

8. The apparatus of claim 7 wherein each said deflector cooperates with less than one-half of said fingers whereby more than one half of golf balls picked up by said disc members and stripped by said fingers are fed into said forward basket so that the balls will be distributed such that said forward and rear baskets generally become filled at the same time.

9. An apparatus for retrieving a plurality of golf balls scattered randomly over the ground comprising a generally rectangular frame having a front, a back and two lateral sides and supported on an axle means and two ground engaging rear wheels adjacent the back of said frame mounted to said axle means and adapted to propel said frame along a direction perpendicular to the front and back of said frame, a plurality of thin circular identical, generally rigid, disc members mounted on said axle means parallel to and laterally spaced inwardly from and between said wheels and adapted to turn with said rear wheels, each said disc member having a diameter such that its perimeter is spaced above ground level to substantially inhibit ground contact, said disc members being spaced laterally of each other such that the spacing between adjacent said disc members being less than the diameter of a golf ball, a plurality of spaced stationary fingers extending into the respective spaces between adjacent said disc members and adapted to remove any golf ball caught between adjacent disc members upon contact therewith during rotation of said disc members, said fingers being mounted forward of said axle means with said fingers extending toward said axle means, a removable basket means in said frame forward of said fingers and positioned to catch any golf ball removed from said disc members by contact with said fingers, a pair of elongated outside guide members extending forward and diverging laterally outward from the lateral extremities of said spaced disc members and positioned parallel to and above ground level and adapted to funnel said golf balls on the ground toward said spaced disc members, and a ground engaging wheel supporting the forward end of each said guide member.

10. The apparatus of claim 9 wherein said axle extends between said lateral sides of said frame, said spaced disc members being sufficient in number to substantially fill the space between said lateral sides along said axle means, said basket means including at least two baskets positioned in front of and parallel to said axle and extended between said lateral sides and supported by said frame.

11. The apparatus of claim 9 wherein said axle means includes a pair of short axles extending laterally inward of respective said lateral sides to an axle support spaced inwardly therefrom, a removable rear basket mounted between said axle supports for catching golf balls, each said short axle having mounted thereon a section of said spaced disc members with respective said fingers for removing golf balls between adjacent said disc members, a concave deflecting member mounted forward of a portion of said fingers in close proximity to said rear basket, the concave side of said deflecting member facing to the rear and extending over the nearest edge of said rear basket to divert some of the golf balls removed by said portion of said fingers into said rear basket.

12. The apparatus of claim 11 which includes two elongated inside guide members which extend from the respective lateral ends of said rear basket forward and converging toward each other and positioned parallel to and slightly above ground level.

13. The apparatus of claim 9 wherein each said disc member includes opposite faces and is formed of a thin circular disc of a plastic material having a plurality of concentric grooves in both said faces adjacent the outside perimeter thereof.

* * * * *